US006698122B1

(12) United States Patent
Merenlender

(10) Patent No.: US 6,698,122 B1
(45) Date of Patent: Mar. 2, 2004

(54) ILLUMINATED BANNER DISPLAY DEVICE

(75) Inventor: Yuval Merenlender, Huntingdon Valley, PA (US)

(73) Assignee: Urban Graphics LLC, Bala Cynwyd, PA (US)

( * ) Notice: Subject to any disclaimer, the term of this patent is extended or adjusted under 35 U.S.C. 154(b) by 0 days.

(21) Appl. No.: 10/411,245

(22) Filed: Apr. 11, 2003

(51) Int. Cl.[7] ..... G09F 13/04; G09F 17/00

(52) U.S. Cl. ..... 40/572; 40/606.18; 40/603; 40/607.11

(58) Field of Search ..... 40/572, 574, 607.11, 40/610, 606.18, 603, 604

(56) References Cited

U.S. PATENT DOCUMENTS

| | | | | | |
|---|---|---|---|---|---|
| 1,712,355 | A | * | 5/1929 | Price | 40/572 |
| 1,820,157 | A | * | 8/1931 | Prochazka | 340/321 |
| 1,974,039 | A | * | 9/1934 | Bohannon et al | 40/215 |
| 3,034,242 | A | * | 5/1962 | Gold | 40/604 |
| 3,831,304 | A | | 8/1974 | Miller et al | |
| 4,662,096 | A | | 5/1987 | Bayless et al. | |
| 6,493,973 | B1 | | 12/2002 | Nelson | |

FOREIGN PATENT DOCUMENTS

JP 2003091249 A * 3/2003 ..... G09F/13/04

* cited by examiner

*Primary Examiner*—Cassandra Davis
(74) *Attorney, Agent, or Firm*—Gregory L. Gore

(57) ABSTRACT

An illuminated display device includes an upper horizontal mount and a lower horizontal mount supported by a vertical pole with two opposite-facing translucent banners suspended between the mounts. The upper mount supports an enclosure which includes illumination means for projecting light downwardly. Two banners of substantially equal length are suspended between the supports and are disposed at an angle to each other, being spaced apart a greater distance at the top than at the bottom. The inside angled surfaces of each banner receive light projected downwardly from the enclosure. The enclosure may also include translucent side surfaces which can carry an advertising display or other printed communication to supplement the information provided on the outside surfaces of the banners. The banners are suspended between the mounting means by rod-and-hook attachments so that the banners can be easily removed and replaced. Resilient suspension of the banner is provided both by the resilience of the banner material itself and also by the resilience of the support arms. The banners are convergent in the downward direction at an included angle of approximately 20 degrees.

14 Claims, 3 Drawing Sheets

3
31
33
17
18
15
34
21
34
21
32
32
3
23
19
16

ILLUMINATED BANNER DISPLAY DEVICE

TECHNICAL FIELD

The invention relates to illuminated display devices which incorporate means for holding banners which contain the display information.

BACKGROUND OF THE INVENTION

Illuminated signs which carry advertising and other display information contained on banners are well-known and often used in the field of advertising. One such example is outdoor pole-mounted banners. As shown for example in U.S. Pat. No. 6,493,973 issued to Nelson, the banners are preferably quickly detachable and vertically suspended from an existing outdoor lamp post by upper and lower mounting brackets. The lamp post may include lighting from above impinging on opposite sides of the banner so that it may be viewed from either side. Thus, the banners typically include display information on both sides. Other examples of outdoor signage which utilize a lamp post and an enclosure which includes both advertising and a street address is shown for example in U.S. Pat. No. 4,662,096 issued to Bayless et al. It is further known to suspend pole-mounted banners vertically a distance apart between parallel pull rods mounting the banners on opposite sides of the supporting pole as shown for example in U.S. Pat. No. 3,831,304 issued to Miller et al.

There is a problem, however, with the prior art banner displays and signage in that reflective sign illumination of vertically disposed banners have several deficiencies. First, they tend to exhibit uneven distribution of light, that is they are very bright on approximately the top third of the banner close to the light source and darker on the lower portion. Secondly, the vertical orientation of the banner is susceptible to glare created by an outside light source. There is a further problem with shadows on the banner caused by banner movement in strong wind. Then there is the added problem that reflective signage is overly reflective in the blank or unprinted areas such that reflective light from these areas distracts the viewer from the displayed information. There is a further need for a simple method to provide a banner display system with means to adjust and maintain the tension of the suspended banners. And finally, vertically disposed banners are very susceptible to color-fading due to the effects of UV radiation from sunlight. There is therefore a need in the art to solve these problems and provide an outdoor lighted banner display system which cures these deficiencies.

SUMMARY OF THE INVENTION

The above problems in the outdoor signage art have been overcome by the present invention which utilizes a unique method of backlighting a pair of hung banners rather than using a light box. This is possible by the use of properly selected semi-translucent banner material and the structure of lighting and suspending the banners that will be more fully described herein.

In accordance with the present invention, an illuminated display device includes an upper horizontal mount and a lower horizontal mount with two opposite-facing translucent banners suspended between the mounts. The upper mount supports an enclosure which includes illumination means for projecting light downwardly. Two banners being of substantially equal length are at an angle to each other, being spaced apart a greater distance at the top than at the bottom. The banners receive light projected from the enclosure which impinges on the inside angled surfaces of each banner. In order to most fully utilize the illuminated enclosure, it may also include translucent side surfaces which can carry an advertising display or other printed communication to supplement the information provided on the outside surfaces of the banners. The banners are conveniently suspended between the mounting means by rod-and-hook attachments so that the banners can be easily removed and replaced. Resilient suspension of the banners is provided both by the resilience of the banner material itself and also the resilience of the upper support arms. Suspended according to the invention, the banners are convergent in the downward direction at an included angle of approximately 20 degrees. Because banners of this type are typically pole mounted and elevated above the viewer's line of sight, the banners of the present invention more directly face the viewer. This provides the added advantage of reducing unwanted glare and reflections from sunlight overhead in the daytime.

The present invention has shown to significantly overcome the deficiencies in the prior art because the lighting of the banners provides a very even distribution of light due to the way in which light is funnel-trapped between the semi-reflective backside surfaces of each banner until it is emitted from the front of the banner toward the viewer. Also, the fact that the banners are backlit obviates glare from the blank or unprinted areas. It should therefore be appreciated that the deficiencies in the prior art have been overcome by the present invention which will be more specifically described with regard to the following drawings and detailed description of the preferred embodiment.

DESCRIPTION OF THE PREFERRED EMBODIMENT

Figure 1:
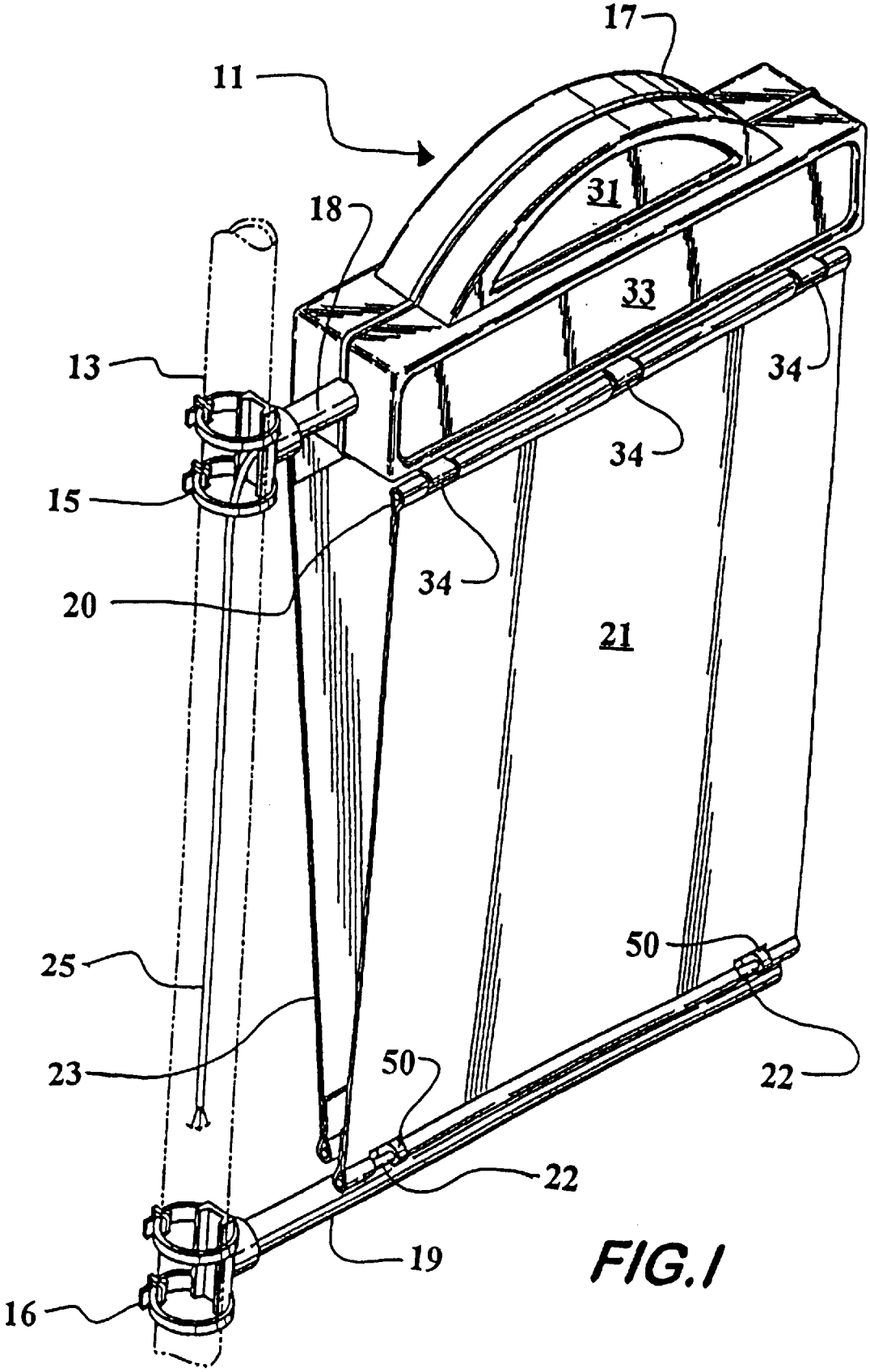
FIG. 1 is a top left front isometric view of the invention with the supporting pole shown in phantom.

Referring now to FIG. 1, the banner system of the present invention 11 is shown suspended from mounting pole 13. Generally, the invention comprises spaced apart upper and lower mounting means with banners suspended between them and angled from the vertical axis. Upper mounting means 15 includes a clamp assembly which holds an upper support beam 18 that supports the top edges of the banners and also supports an illuminated enclosure 17. A lower support beam 19 includes similar clamp means 16 which rigidly secures the lower support beam 19 to the mounting pole. The upper and lower support beams include mounting attachments which hold opposing upper and lower support rods 20 and 22 between which the banners 21 and 23 are stretched. This includes top support arms 34 and lower attachment brackets 50. The illuminated enclosure includes lighting means which is powered by electrical supply line 25 that passes internally through the mounting pole, however it should be understood that it could be any other convenient means of supplying electrical power to the enclosure. The enclosure 17 further includes two display surfaces 31 and 33 at the sides upon which messages, artwork or address indicia may be applied. The banners preferably include messages, advertising, street address indicia, or other artwork as desired.

Figure 2:
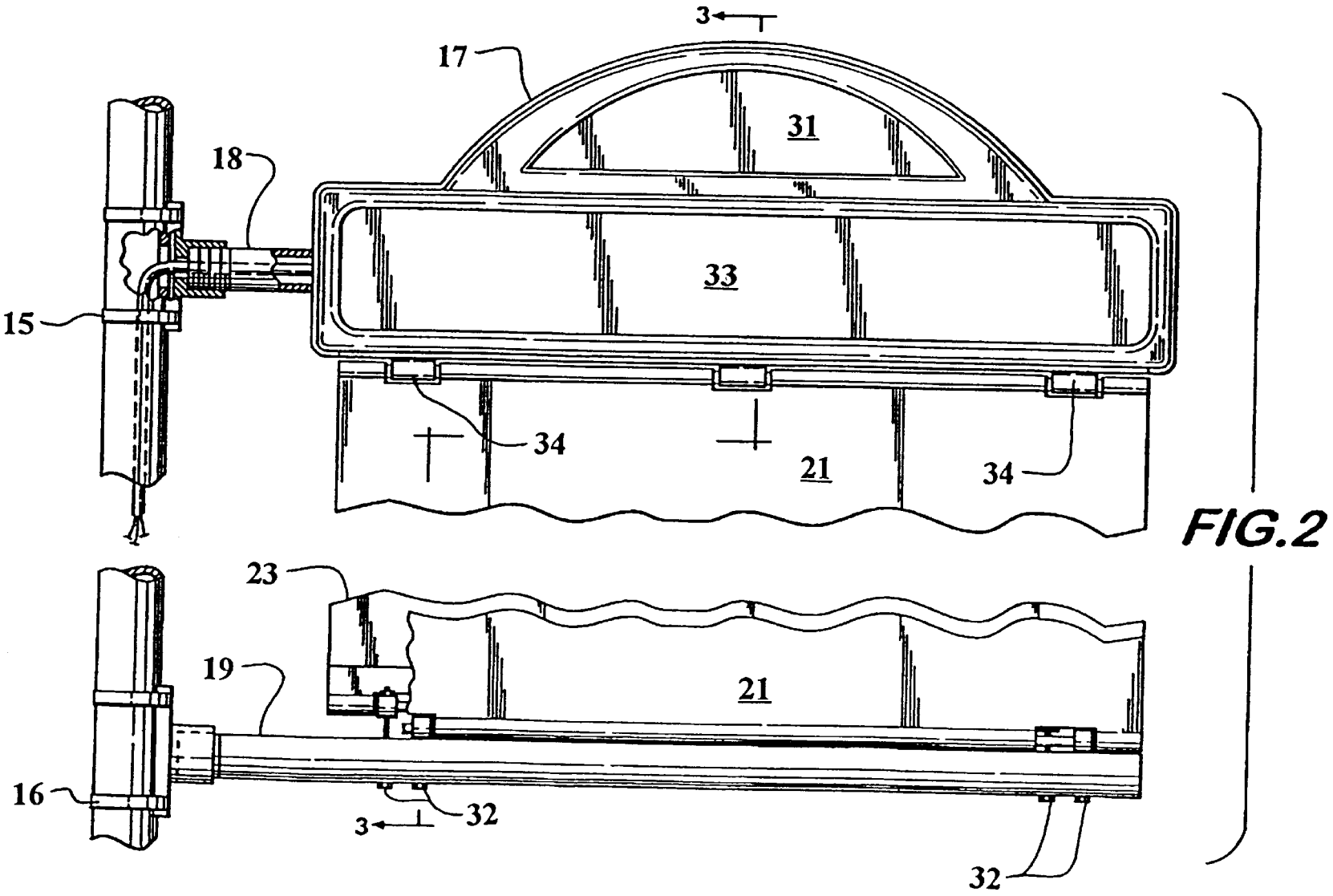
FIG. 2 is a partial cut-away front view.

Referring now to FIG. 2, a front view of the present invention shows greater detail of the pole support beam mounting means and the attachment means at the top and bottom edges of the banners 21 and 23. The pole mounting means include clamp and socket assemblies into which upper and lower supports beams 18 and 19 may be threadably attached. Tension on the banners is provided by adjusting the bolts 32 which move the lower mounting brackets either up or down, and are located along the bottom of the lower support beam. Resilient suspension of the banners is provided both by the resilience of the banner material and also resilience of the upper support arms 34 as will be more fully described with regard to FIG. 3. The banner material is preferably of the semi-translucent type such as a material sold by 3M company under the product name Panagraphics II. This material is readily available and well-known in the banner signage arts as being suitable for backlighting. The surfaces 31 and 33 of the illuminated enclosure 17 are front-facing and mirror image surfaces are located on the rear side of the enclosure (not shown) for the same purpose.

Figure 3:
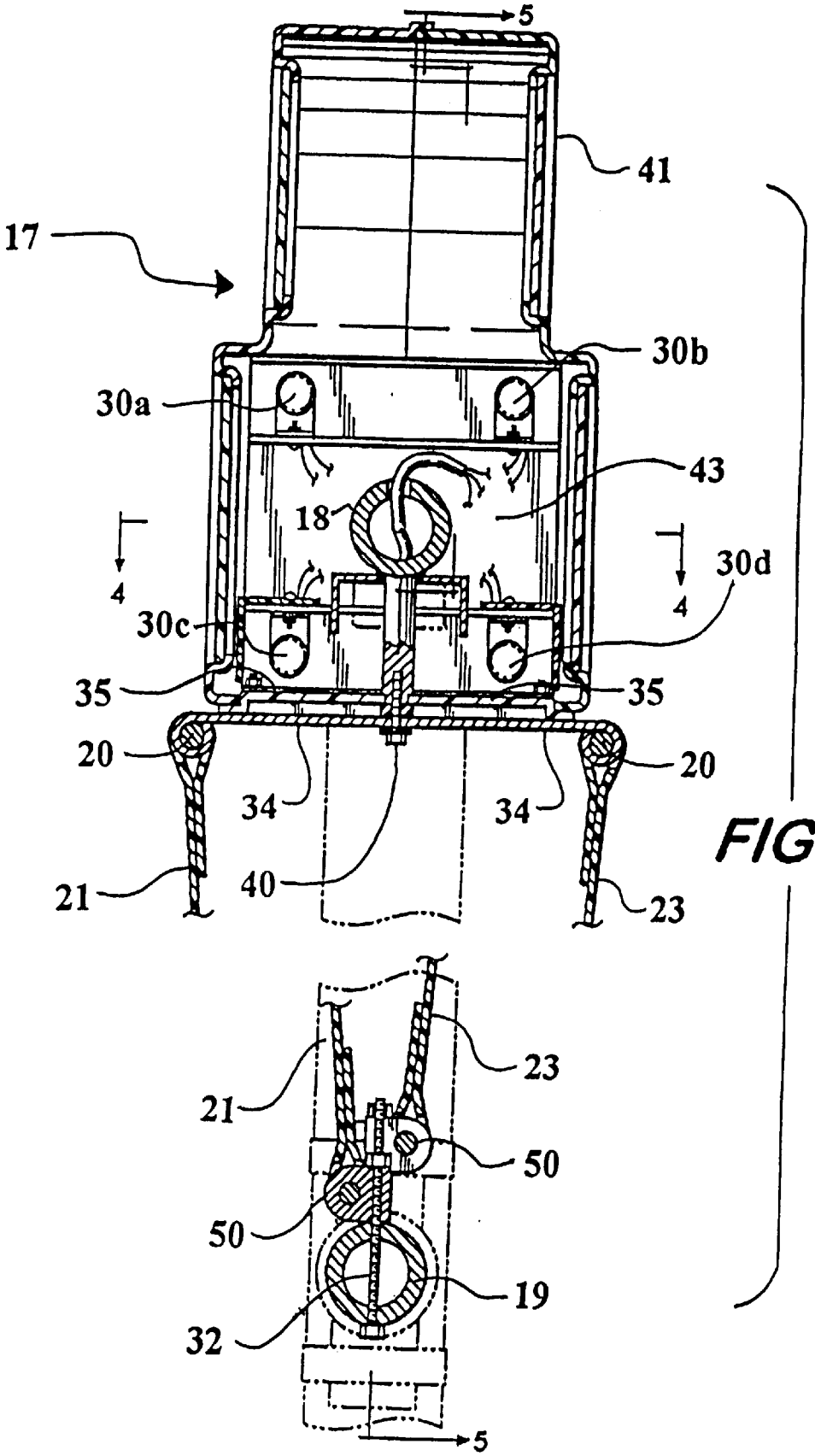
FIG. 3 is a side sectional view taken from FIG. 2 as shown in that figure.

Referring now to FIG. 3, yet greater detail of the illuminated enclosure and banner support mechanism is depicted. The illuminated enclosure includes a housing 41 supported by a frame 43 which is mounted to the upper support beam 18. The frame 43 carries mounting means for high intensity light bulbs 30*a*–30*d* that are distributed in upper and lower regions in the lower portion of the enclosure. The bulbs are electrically connected by circuitry well-known in the electrical arts that separately form no part of the present invention. The bottom bulbs 30*c* and 30*d* project light downwardly through a transparent plate 35 which extends across the bottom of the enclosure 17. It will be readily understood that the downward projecting light from these bulbs impinges upon backside surfaces of the angled banners creating a backlit visual display of the banners. Light which is not transmitted through the banner is reflected in the direction of the backside surface of the other banner and so forth. In this way, a high degree of all downward-projected light from the enclosure is evenly distributed upon, and transmitted through, the banners. Furthermore, the bulbs illuminate the entire inside space of the enclosure so that all translucent surfaces of the enclosure project light outwardly.

The upper support beam further includes mounting means for the banner support arms 34 which extend longitudinally from just beneath the enclosure. Each support arm is centrally affixed to a downwardly-projecting extension of upper support beam 18 being affixed thereto by screw means 40. The preferred embodiment depicts three support arms, however it should be understood that any number of two or more arms may be employed. The ends of each of the support arms have a sleeve for receiving support rods 20 which pass through cavities inside hemmed endfolds of the banners 21 and 23 to achieve releasable attachment between the support arms and the banners by sliding the rods laterally. The support arms 34 are preferably composed of a resilient material such that when banner tension is applied to the ends of the arms, the arms will resiliently deflect downward in bending beam fashion. This spring action of the support arms maintains the tension on the banners.

Referring further to FIG. 3, the bottom edges of the banners 21 and 23 are likewise attached through similar loop-and-rod attachment by appertured brackets 50 which are secured by adjustment bolts 32 to the lower support beam 19. In this figure, the support brackets of each banner are depicted at a different height to show the range of adjustment provided by the bolts 32. Thus, each banner is secured at the bottom by separately adjustable brackets which allow the individual tension adjustment of each banner. As previously described, support arms 34 will deflect downwardly as the tension on the banners is increased by tightening bolts 32.

It should be understood that there may be other modifications and changes to the present invention that will be obvious to those of skill in the art from the foregoing description, however, the present invention should be limited only by the following claims and their legal equivalents.

What is claimed is:

1. An illuminated display device, comprising:

an upper mounting means;

a lower mounting means, an enclosure supported by said upper mounting means and including illumination means therein for projecting light downwardly therefrom; and two opposite-facing semi-translucent banners suspended between said upper and lower mounting means below said enclosure, said banners being of substantially equal length and spaced apart a greater distance at top ends thereof than a spacing distance at bottom ends thereof such that said light from said illumination means is projected downwardly between said banners impinging backside surfaces thereof.

2. The display device of claim 1 wherein said upper mounting means includes a horizontal support beam which extends into said enclosure.

3. The display device of claim 2 further including a plurality of support arms connected to said upper support beam, said arms extending longitudinally from said support beam and further including looped ends for the retention of upper support rods attached to said banners.

4. The display device of claim 3 wherein said upper support arms are composed of a resilient material whereby a bending beam resilient spring force is applied to the banners to maintain tension on the banners.

5. The display device of claim 1 wherein said enclosure includes translucent side surfaces for projecting light therethrough.

6. The display device of claim 3 further including vertical support means affixed to said upper and lower mounting means for rigidly holding them in spaced relation.

7. The display device of claim 6 wherein said vertical mounting means is a single pole.

8. The display device of claim 7 wherein said lower mounting means includes rod and loop attachment means for securing said banner to a lower support beam.

9. The display device of claim 8 wherein said lower mounting means further includes movable brackets which are vertically adjustable by screw means connecting said brackets to the lower support beam.

10. The display device of claim 9 wherein a bottom side of said enclosure includes a transparent panel for transmission of said downward projecting light from within said enclosure.

11. The display device of claim 10 wherein said banners are convergent in the downward direction at an included angle of approximately 20 degrees.

12. The display device of claim 11 wherein each banner is suspended at an angle of approximately 10 degrees from a vertical axis of said device.

13. The display device of claim 12 wherein said enclosure translucent side surfaces further include street address indicia.

14. The display device of claim 13 wherein said enclosure translucent side surfaces further include an advertising display.

* * * * *